US005577547A

United States Patent [19]

Hosamani

[11] Patent Number: 5,577,547

[45] Date of Patent: Nov. 26, 1996

[54] METHOD OF CASTING A METAL ARTICLE

[75] Inventor: Laxmappa Hosamani, Beaverton, Oreg.

[73] Assignee: Precision Castparts Corp., Portland, Oreg.

[21] Appl. No.: 236,216

[22] Filed: Apr. 28, 1994

[51] Int. Cl.[6] ..... B22D 27/04

[52] U.S. Cl. ..... 164/122; 164/338.1

[58] Field of Search ..... 164/122.1, 122.2, 164/122, 125, 127, 338.1

[56] References Cited

U.S. PATENT DOCUMENTS 3,861,449 1/1975 Barbero .
4,609,029 9/1986 Vishnevsky et al. .
4,724,891 2/1988 Brookes .
4,809,764 3/1989 Prasad .
4,863,553 9/1989 Lehoczky et al. ..... 156/616.41
5,275,227 1/1994 Staub ..... 164/122.1

*Primary Examiner*—Kuang Y. Lin
*Attorney, Agent, or Firm*—Klarquist Sparkman Campbell Leigh & Whinston

[57] ABSTRACT

A method for casting long thin metal articles is described. A particular embodiment is directed to the casting of seals that are used in the low pressure turbine section of a gas turbine engine. The method first involves forming a mold, and then preheating the mold so that the temperature towards the upper portion of the mold is close to the liquidus temperature of the metal composition being cast. The temperature of the bottom portion of the mold is below the solidus temperature of the metal alloy composition. After the metal is poured into the mold cavity, the mold heating system preferably is moved at a selected rate so that the portion of the mold being heated by the furnace is slowly decreased. Withdrawal rates slower than about 30 inches per hour produce satisfactory casting results.

27 Claims, 6 Drawing Sheets

METHOD OF CASTING A METAL ARTICLE

FIELD OF THE INVENTION

The present invention concerns a method for casting metal articles, particularly metal articles having a long thin portion.

BACKGROUND OF THE INVENTION

Metal articles that have long and thin portions and an equiaxed grain structure typically are cast with molds having gates placed at various locations along the length of the mold cavity. This gating is used to conduct molten metal which compensates for the decrease in the volume of the metal during solidification. The number of gates that are required depends upon the relationship between the length of the article being cast and the thickness of the article. It has been a common practice to provide gates which are spaced apart along the length of a mold by a distance of between 3 to 12 times the thickness of the article being cast. From ten to thirty-six gates would be required for an article having a maximum thickness of about 0.1 inch and a length of about 12 inches.

Gates promote the formation of defects in castings. For instance, hot tears and/or distortion tends to occur in positions of the cast article corresponding to gate locations in the mold. In addition, a stub usually remains at each gate location. These stubs must be removed, which is difficult to do when the cast article is curved. Another disadvantage associated with the use of gates is that an area of distinctly larger grain size is formed in the cast article at each gate location.

Long and thin metal articles previously have been cast with a directionally solidified or columnar grained crystallographic structure. When this is done, the entire mold is preheated to a relatively high temperature, which is substantially above the liquidus temperature of the metal. Superheated molten metal is then poured into the preheated mold. The mold is heated during the pouring process so that the metal is molten during and immediately after pouring. After the mold has been filled with molten metal, the molten metal is solidified upwardly in the mold cavity along a horizontal front. The casting of thin articles is described in U.S. patent application, Ser. No. 813,247, now U.S. Pat. No. 4,724,891, filed Dec. 24, 1985, by Ronald R. Brookes and entitled Thin Wall Casting. A general method of directionally solidifying a casting is described in U.S. Pat. No. 4,609,029.

Prasad's U.S. Pat. No. 4,809,764 (the '764 patent) entitled "Method of Casting a Metal Article," which was filed on Mar. 28, 1988, also describes a method for casting long and thin metal articles. The '764 patent is incorporated herein by reference. Although the '764 patent provides important information concerning casting nickel-chromium articles, it provides no information concerning other alloy compositions. This patent also specifically teaches that the rate of withdrawing the mold from the furnace during solidification need only be as slow as about 60 inches/hour to provide suitable, defect-free metal articles. More significantly, the '764 patent teaches preheating the upper portion of the mold to temperatures only at or slightly above the solidus temperature of the cast metal. There is no appreciation in the '764 patent of the particular benefits of heating the upper half of the mold close to the liquidus temperature of the metal composition.

SUMMARY OF THE INVENTION

The present invention concerns a method for casting a metal article which is long and thin, or which has a long and thin portion. The metal article also is cast with an equiaxial grain structure. An equiaxial grain structure has numerous, randomly oriented grains which are the result of random nucleation and grain growth during metal solidification. The article is cast in a mold having a mold cavity configured to correspond to the shape of the desired metal article. There are no gates or risers along the length of the long thin portion of the mold cavity.

The prior art patents discussed in the Background of the Invention teach techniques that produce exceptionally sound castings, but only in the configurations and size ranges actually tested. These methods alone do not produce the exacting degree of thermal control over the complete solidification range of some of the very complex geometries which engine manufacturers require. The present invention provides new teachings, not apparent in view of the previous prior-art patents, that greatly extend the capabilities of the basic technologies previously disclosed.

In general, the present process involves forming a mold having a mold cavity configured in the shape of a desired seal, and then preheating the mold with any suitable heating system, such as a furnace. The mold is preheated so that a lower half of the portion of the mold in which the long thin portion of the article is cast is at a temperature which is close to but less than the solidus temperature of the metal. The upper half of the mold in which the long thin portion of the article is cast is heated to a temperature which is close to the liquidus temperature of the metal. Molten metal, typically superheated molten metal, preferably is poured into the mold cavity through only an inlet provided by a gate or runner at the upper end of the mold cavity. If desired, a second gate or a riser could be connected with the lower end of the mold cavity.

From previous work, it appears that during and immediately after pouring the molten metal simultaneously solidifies along at least fifty percent of the surface area of the lower half of the portion of the mold cavity in which the long thin portion of the article is cast, and along at least fifty percent of the surface area of the upper half of the portion of the mold cavity in which the long thin portion of the article is cast. Thereafter, the molten metal in the lower half portion of the long thin portion of the mold is completely solidified. The molten metal solidifies with an equiaxed grain structure. The decrease in the volume of the solidified metal is compensated for by feeding metal to the long thin portion of the mold cavity through the inlet at which molten metal was originally conducted to the long thin portion of the mold cavity.

A particular embodiment of the present invention is directed to the casting of seals that are used in the low pressure turbine section of a gas turbine engine. These parts have a thin wall along a significant portion of the part, and some heavier sections towards both ends of the part. The thickness of the thin wall typically varies from about 0.02 inch to about 0.120 inch, even more typically from about 0.030 to about 0.090 inch. The length of these parts also may vary, but typically is from about 4 inches to about 12 inches. The width, which also may vary, typically is from about 1.5 inches to abut 3.5 inches.

Seals commonly are made by fabricating the parts from sheet metal. Controlling the dimensions of the article is difficult due to the extensive welding and brazing that is required during the fabrication process. For example, an important consideration for casting seals is the contour configuration. If the contour is not correct, then the part will not fit correctly. This produces hot gas leaks and reduces the performance of the engine. Also, the cost of fabrication goes up as the complexity of the parts increases.

Moreover, such seals cannot be produced by fabrication methods as the temperature resistance capability of the materials used to make the parts increases. This is because such alloys do not lend themselves to the fabrication process. For instance, such alloys typically cannot be rolled or otherwise placed in a sheet form, which is required to produce parts for the fabrication process. Also, it is common that such alloys cannot be welded because the alloy cracks during the welding process.

The present invention therefore provides a method for casting seals in an equiaxial grain structure wherein such seals typically have a length of greater than about four inches. The length also typically is at least twenty times the thickness of the long thin portion of the seal. A mold is formed configured to the shape of the desired article. The mold defines a mold cavity having a long thin portion which is more than about four inches long, and which is at least about twenty times the thickness of the long thin portion of the mold. The long and thin portion of the mold cavity is free of gating along its entire length.

The mold is positioned in a furnace for preheating so that a longitudinal axis of the long thin portion of the mold cavity is in an upright orientation. The furnace is designed to substantially surround the mold. The step of heating the mold includes heating a lower half of the portion of the mold that defines the long thin portion of the mold cavity into a first temperature range. An upper half of the portion of the mold that defines the long thin portion of the mold cavity is heated into a second temperature range. The highest temperature of the first temperature range is close to but less than the solidus temperature of the metal. The highest temperature of the second temperature range is close to the liquidus temperature of the metal.

The molten metal is conducted into the mold cavity at a location other than along the length of the long thin portion of the mold cavity. The molten metal is conducted into the mold cavity while the lower half of the portion of the mold defining the long thin portion of the mold cavity is in the first temperature range, and while the upper half of the portion of the mold defining the long thin portion of the article mold cavity is in the second temperature range. Thereafter, the molten metal is solidified in the article mold cavity with an equiaxed grain structure.

The step of solidifying the molten metal in the mold preferably includes withdrawing a heating system, such as a furnace, at a predetermined rate from around at least that portion of the mold cavity which defines the long thin portion of the cast metal article. Of course, one skilled in the art will realize that the term "withdraw," or variations of this term, refers simply to moving the furnace away from a position of surrounding the mold. This could be done by moving the furnace vertically either upwardly or downwardly. Presently, the best mode of withdrawing the furnace appears to be by using a hydraulic system to move the furnace vertically upwardly. Moving the furnace instead of the mold is a significant departure from the teachings of the prior art. Prior-art processes required moving the mold from within the furnace, rather than moving the furnace from around the mold. Moving the mold while the metal solidifies is believed to produce defects in the resulting metal articles. Moving the mold apparently perturbs the metal in the mold as it solidifies.

Prior-art processes not only taught withdrawing the mold from the furnace, but also taught that mold-withdrawal rates should, in practice, be faster than about 60 inches per hour. This produced metal articles that were substantially free of defects for certain nickel-chromium alloys. Rates as high as 60 inches per hour have been found to be unacceptable for producing the long and thin parts that are illustrated by the particularly preferred embodiments of the present invention. As a result, rates slower than about 30 inches per hour, and preferably less than about 15 inches per hour, and even more preferably less than about 7 inches per hour, have been found to produce superior results, particularly for alloys other than nickel chromium.

Accordingly, it is an object of this invention to provide an improved method for casting a relatively long thin article, or an article having a long thin portion, with an equiaxed structure from superalloys without providing gates at locations along the length of a long thin portion of the mold cavity.

Another object of this invention is to provide a new and improved method as set forth in the preceding object wherein the upper half of the long thin portion of the mold is preheated to a temperature range in which the highest temperature is close to the liquidus temperature of the metal alloy.

Still another object of the present invention is to provide a method for casting articles from various metal compositions by maintaining the upper half of the long thin portion of the mold cavity close to the liquidus temperature during a significant portion of the casting process by reducing furnace withdrawal rates to about 7 inches per hour (about 0.1 inch per minute) from about 60 inches per hour (about 1.00 inch per minute). Another object of the present invention is to induce cooling by withdrawing the furnace from surrounding the mold, thereby maintaining the mold in a steady and upright position during metal solidification, thereby reducing defects in the cast article.

DETAILED DESCRIPTION OF THE PREFERRED EMBODIMENTS

A. Metal Article

Figure 1:
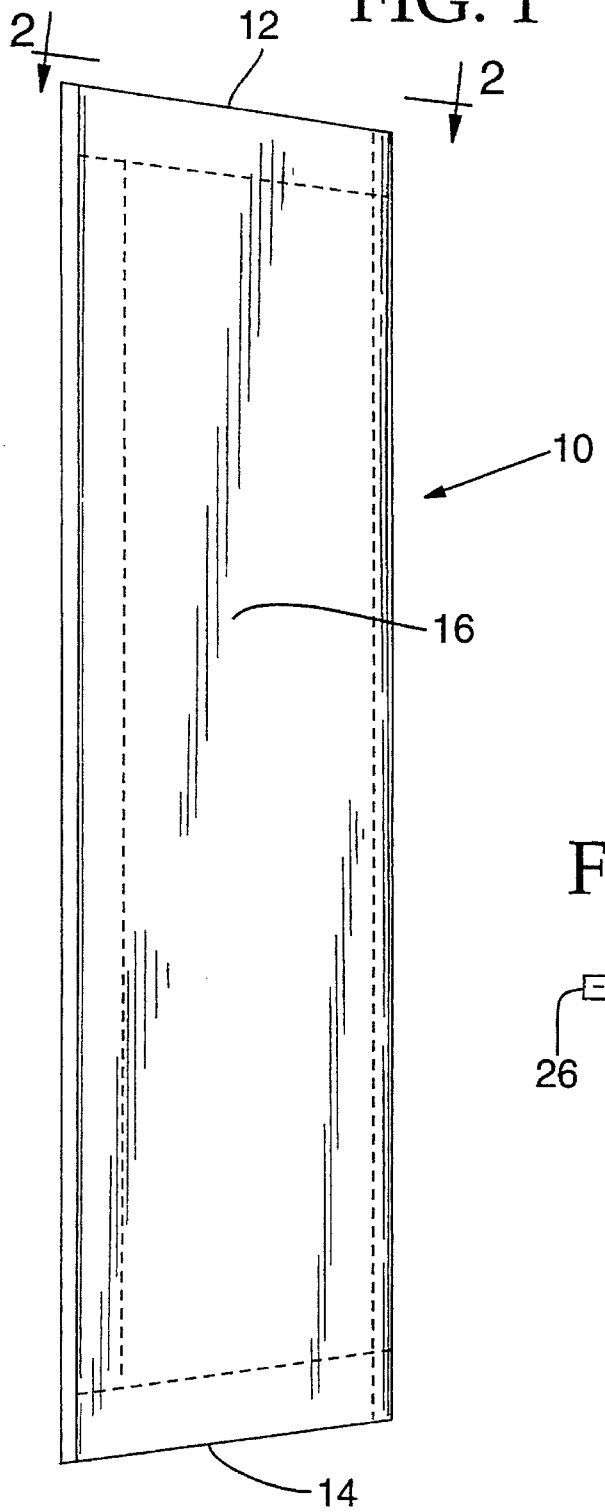
FIG. 1 is a plan view of a metal article having a long thin portion which is cast according to the method of the present invention.
Figure 2:
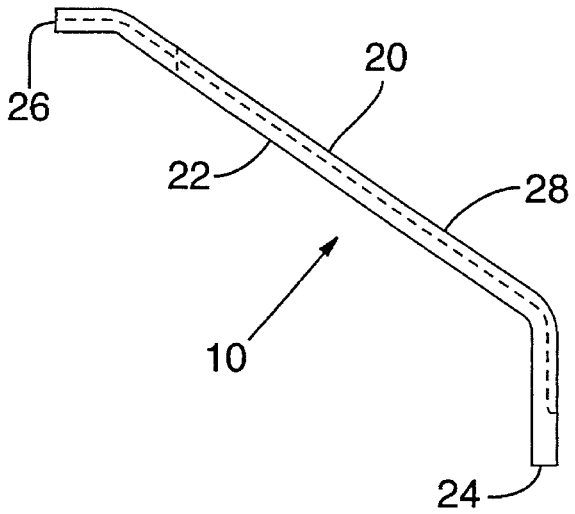
FIG. 2 is a sectional view, taken generally along the line 2—2 of FIG. 1, illustrating the configuration of the long thin portion of the metal article.

Metal articles having a long and thin portion and cast according to the method of the present invention are illustrated in FIGS. 1–2. However, it should be understood that the present invention can be used to cast many different articles. It also should be understood that the present invention is particularly directed to casting articles with an equiaxed grain structure.

The article 10 illustrated in FIG. 1 is referred to as a seal for use in turbine engines. Due to the relatively severe operating conditions to which such parts are exposed, they may be made from a variety of metal compositions selected particularly for that function. Such metal compositions typically are selected from the group consisting of nickel-chromium superalloys, cobalt-chromium superalloys, and iron-chromium superalloys, more preferably from the group consisting of cobalt-chromium superalloys and iron-chromium superalloys. Specific examples of alloys that actually have been used to practice the process of the present invention are provided in the following lists. These alloys are commercially available from such companies as Certified Alloys.

The Ni-based alloys include, without limitation: (1) 713C (74 percent Ni, 12.5 percent Cr, and 0.0 percent Co); (2) 713LC (75 percent Ni, 12.0 percent Cr, and 0.0 Co); (3) B-1900, which has a melt range of about 2,325° F. to about 2,375° F., (60 weight percent Ni, 8 percent Cr, and 10 percent Co); (4) C-1023 (58 percent Ni, 15.5 percent Cr, 10.0 percent Co); (5) IN-738LC, which has a melt range of from about 2,250° to about 2,400° F. (61 percent Ni, 16 percent Cr, 8.5 percent Co); (6) IN-939 (48 percent Ni, 22.5 percent Co, 9.0 percent Co); (7) Rene 77 (58 percent Ni, 14.0 Cr, and 15 percent Co); and (8) Rene 41, which has a solidus temperature of about 2,400° F. and a liquidus temperature of about 2,500° F. (55 percent nickel, 11 percent cobalt, 19 percent chromium and 10 percent Mo).

The cobalt-based alloys include, without limitation: (1) FSX-414 (10 percent Ni, 29 percent Cr, and 52 percent Co); and (2) MAR-M-509 (10 percent Ni, 23.5 percent Cr, and 55 percent cobalt).

The preceding lists should not be seen as limiting the present invention to the particular compositions listed. Rather, the purpose is to provide a non-exhaustive list of alloy compositions that have been used to practice this invention. Moreover, one skilled in the art can determine, amongst other pertinent information, the composition for each alloy by consulting such books as "Superalloys," edited by Chester Simms, and published by John Wiley & Sons (1987).

It also is necessary to determine the liquidus and solidus temperatures for the alloy compositions used to cast the metal articles. This information also is available to those of skilled in the art from various technical publications. However, in practice the solidus and liquidus temperatures for a particular alloy composition typically are empirically determined immediately prior to casting parts from the composition. This is done by a technique known by those skilled in the art as DTA, or differential thermal analysis.

Metal article 10 has an upper end portion 12 and a lower end portion 14. A long thin portion 16 extends between and is cast as one piece with the upper and lower end portions. Of course, the dimensions of articles such as article 10 may vary. The article 10 illustrated in FIG. 1 is a seal having a length of approximately 8.25 inches. The portion 16 of article 10 has a length of approximately seven inches, and a width of approximately 2.5 inches. Thus, the distance between the edge portion 24 (FIG. 2) of article 10 and an edge portion 26, as measured along a central axis 28, is approximately 2.5 inches, although this distance typically varies along the length of portion 16. The portion 16 of article 10 has a maximum thickness of approximately 0.12 inch, and the thickness typically is from about 0.02 inch to about 0.120 inch, more typically from about 0.03 to about 0.090.

Sections 12 and 14 of the one-piece article 10 are substantially thicker than the portion 16. Thus, the sections 12 and 14 have a width of approximately two and a half inches and a height of approximately five eighths of an inch. Article 10 may have a configuration other than the specific configuration illustrated in FIGS. 1–2. For example, one or both sections 12 and 14 could be omitted if desired.

Although article 10 as illustrated in FIGS. 1–2 was formed from a cobalt-chromium superalloy, it is contemplated that seals or other articles cast in accordance with the method of the present invention can be formed of different metals. For example, articles which are long and thin, or that have portions which are long and thin, may be cast of cobalt based alloys or iron based alloys. However, it is believed that the present invention will be particularly advantageous in the casting of cobalt-chromium superalloy seals. When prior-art methods of casting were tried for cobalt-chromium and iron-chromium alloys, such methods were found to produce unsatisfactory parts. Possible reasons for this include the chemical differences between the compositions and the differences between the withdrawal rates of the mold from the furnace.

Thus, the present invention is particularly directed to a new method of casting superalloys, in addition to the nickel-chromium superalloy discussed in U.S. Pat. No. 4,809,764. A superalloy is an alloy that can withstand relatively high temperatures, such as greater than about 600° F., and typically greater than about 1,000° F. Without limitation, the alloy compositions of the present invention typically are selected from the group consisting of nickel-chromium superalloys, cobalt-chromium superalloys and iron-chromium superalloys. The alloy compositions preferably are selected from the group consisting of cobalt-chromium superalloys and iron-chromium alloys, with the cobalt-chromium superalloys being particularly preferred alloy compositions.

Portion 16 of article 10 is long and thin. As used herein, "long" means a length of greater than about 4 inches. The length of long metal articles also typically is greater than about twenty times the thickness of the long portion. For instance, portion 16 of seal 10 as illustrated in FIGS. 1–2 has a length which is approximately eighty-seven times the thickness of portion 16. "Thin" typically refers to an article having a thickness of from about 0.020 inch to about 0.120 inch, and even more typically from about 0.030 inch to about 0.090 inch.

Figure 3:
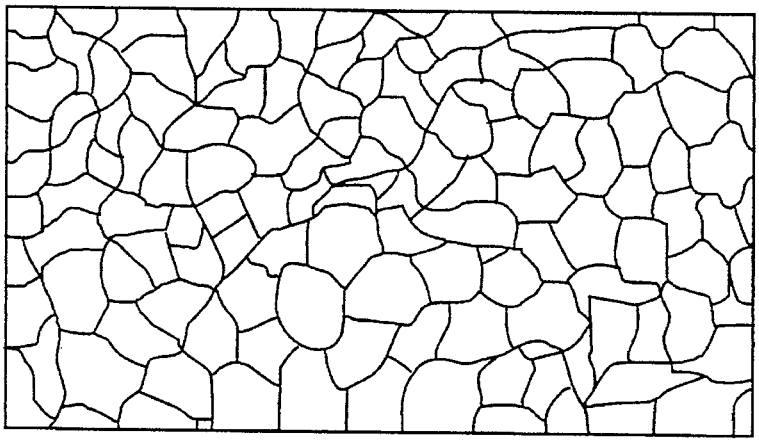
FIG. 3 is a greatly enlarged view illustrating equiaxed grains of the cast article of FIGS. 1 and 2.

Article 10 is cast with an equiaxed grain structure as illustrated in FIG. 3. An equiaxial grain structure has numerous, randomly orientated grains which are the result of random nucleation and grain growth during metal solidification. The surface grains have a maximum dimension of one half of an inch or less, maybe less than one quarter of one inch. Long thin blades and/or vanes have been formed with columnar grain structure or as a single crystal; however, an equiaxed grain structure is the most economical.

B. Casting The Article

When casting an equiaxed metal article which is long and thin, or which has a portion which is long and thin, it is customary to provide gates or passages at a plurality of locations along the length of the article. These customary gates or passages are used to introduce molten metal to the long thin portion of the mold cavity when filling the mold cavity with molten metal. The gates or passages also are used to conduct molten metal to the long thin portion of the mold cavity to compensate for the decrease in the volume of the metal as it solidifies.

Ten to thirty-six gates likely would be required if conventional casting practices were used to cast vanes similar to vane 10 of FIGS. 1–2 in U.S. Pat. No. 4,809,764. Such gates would be spaced apart along the convex side of the long thin portion of the mold cavity in which the airfoil portion 16 was to be cast. This particular vane had a long thin airfoil portion with a length of 11 inches and a maximum thickness of 0,120 inches. The number of gates which conventional practice indicates should be used varies depending upon the type of mold, the metal being cast, and many other factors.

Using gates to cast long thin articles of equiaxed metal substantially increases the cost of producing the article. The metal which solidifies in the gates becomes scrap. In the case of expensive alloys, this contributes significantly to the cost of the article. In addition, the gates frequently result in casting defects, such as excessively large grains, hot tears and/or distortion.

When gates are connected with a curved surface in a mold, a stub-end portion of the gate must be carefully ground away. The grinding must be carefully performed in order to provide the cast article with a continuous surface having the desired curvature. The grinding away of gate stubs from major side surfaces 20 and 22 of the article 10 would be a laborious, time consuming and expensive process.

In accordance with a feature of the present invention, no gates were used along the length of the long thin portion of the mold cavity in which the articles 10 were cast with an equiaxed grain structure. An article mold 38 (FIG. 4) having only a single inlet at its upper end was used to cast articles 10. There are no gates along the sides of the article mold 38. However, it is contemplated that a blind riser or a gate could be provided at the lower end of the article mold if desired. The casting process was conducted in such a manner as to result in articles 10 having a fine equiaxed grain structure, similar to the grain structure shown in FIG. 3. Articles 10 were free of shrinkage defects, hot tears and distortion.

For reasons of economy, it is preferred to cast a plurality of seals at a time using a one-piece mold structure 42. It should be understood that although only two article molds 38 have been shown in FIG. 4, the mold structure 42 may have eight, twelve, sixteen, twenty or more article molds 38 disposed in an annular array or cluster about a solid support post 44. Currently, mold structure 42 is designed to include a circular array of twenty article molds 38.

A pour cup 46 is supported on an upper end of the support post 44. A plurality of gates or runners 48 extend outwardly from the pour cup 46 with one runner going to each article mold 38. The article molds 38 are supported on a circular base plate 52 by ceramic spacer blocks 54 having a height of three eighths to one and one half inches. The spacer blocks 54 support the closed lower end portions of the article molds 38. The spacer blocks could be eliminated or could have different dimensions if desired.

When the mold structure 42 is to be made, a wax pattern is assembled. The wax pattern includes a plurality of article patterns having the same configuration as the configuration of the article to be cast, that is the same configuration as articles 10. The article patterns did not have any gate patterns disposed along the length of the article patterns.

The wax patterns of articles 10 are connected with wax patterns having a configuration corresponding to passages in the gates or runners 48. There is only one gate or runner passage pattern connected to the upper end of each article pattern. The runner passage patterns are in turn connected with a pattern corresponding to the shape of the inside of the hollow pour cup 46. A ceramic spacer block 54 is connected with a lower end of each article pattern.

The entire pattern assembly is repetitively dipped in a slurry of ceramic mold material and stuccoed to build up a layer of mold material over the pattern assembly. Once a layer of desired thickness has been built up over the pattern assembly the layer is dried. The wax pattern material is then melted and removed from the ceramic layer by the use of heat and/or chemical solutions. The ceramic mold material is then fired to give it the requisite strength and to complete the process of forming the mold structure 42.

The process of making a mold structure similar to the mold structure 42 by the foregoing process is well known. However, it should be noted that the wax pattern and resulting mold structure does not have any provision for gating passages to side portions of the article molds 38. The only passages for conducting molten metal to the article molds 38 from the pour cup 46 are in the runners 48.

C. First Embodiment for Mold-Furnace Withdrawal

When articles 10 are to be cast, the mold structure 42 is placed on a circular water-cooled copper chill plate 60. Although the closed lower ends of the article molds are close to the chill plate 60, they are separated from the chill plate by three eighths to one and one half inches of ceramic material. The longitudinal central axes of article mold cavities in the article molds 38 are perpendicular to a horizontal upper side surface 62 of the chill plate 60.

A motor (not shown) then moves a cylindrical support post 64 for the chill plate 60 vertically upwardly. As the chill plate 60 moves upwardly the mold structure 42 enters a chamber or housing (not shown) which encloses a furnace 68. Continued upward movement of the chill plate 60 moves the mold structure 42 into a cylindrical furnace chamber 72. The housing enclosing the furnace 68 is then evacuated and the mold structure 42 is preheated.

The furnace preheats the mold structure 42 in a nonuniform manner. Thus, there is a temperature gradient which increases from a low temperature at the lower end of the article molds 38 to a higher temperature at the upper ends of the molds 38. An imaginary horizontal plane 76 extends through the centers of the long thin portions of the molds 38 and divides the long thin portions of the molds 38 into a lower half 82 and an upper half 84.

The lower half 82 of the long thin portions of each of the article molds 38 is heated into a first temperature range. The highest temperature in this first temperature range is close to but is less than the solidus temperature of the metal of article 10. The upper half of the long thin portions of each of the article molds 38 is heated into a second temperature range in which the temperatures are higher than the temperatures in the first temperature range. Since the upper and lower halves 82 and 84 of the long thin portions of the article molds 38 are separated by only an imaginary plane 76, the lowest temperature in the second temperature range into which the upper half 84 is heated is the same as the highest temperature of the temperature range into which the lower half 82 is heated.

It has been surprisingly determined that superior casting results are obtained when the highest temperature of the second temperature range into which the upper half 84 of a long thin portion of mold 38 is heated is close to the liquidus temperature of the molten metal of article 10. As used herein, the phrase "close to" is determined first by considering the specific composition and configuration of the particular part that is being cast. In general, the longer and thinner the part is, the closer the upper half 84 of a long thin portion of mold 38 should be heated to the liquidus temperature of the metal. One skilled in the art therefore will realize that the exact temperatures to which the mold is heated may vary. However, by way of example and without providing any limitation upon the range of temperatures that are included in the phrase "close to," it currently is believed that the best casting results are obtained when the temperatures, and particularly the second temperatures, are within 150° F., preferably within about 100° F., even more preferably within about 50° F., and still even more preferably within about 25° F. of the solidus and liquidus temperatures. Nevertheless, the highest temperature to which the upper half 84 of a long thin portion of an article mold 38 is heated is significantly greater than the solidus temperature of the metal of article 10, which is contrary to the teachings of U.S. Pat. No. 4,809,764.

Due to many different factors, the vertical temperature gradient along the mold 38 will probably not increase in exactly a uniform manner from the lower end of an article mold 38 to the upper end of the article mold. However, the temperature gradient probably will be similar to a uniform temperature gradient. It should be understood that the lower end of the article mold 38 is preheated to the lowest temperature and the upper end of the article mold is preheated to the highest temperature.

Preheating the lower half 82 to a temperature which is less than the temperature of upper half 84 is facilitated by having the mold structure 42 supported by the chill plate 60. The furnace illustrated in FIG. 4 includes plural helical heating elements 90, 92 and 94, although a first alternative embodiment of the furnace (FIG. 8) includes only two helical heating elements **90*a* and 92*a*, and a second alternative embodiment of the furnace (FIG. 9) includes only one continuous helical heating element 90*b*, which promotes the desired temperature gradient. When plural heating coils are used, the amount of electrical energy which is conducted to such coils (eg. coils 90, 92, 94) may result in a differential in the heat energy transmitted through a graphite susceptor 96 to the article molds 38**.

Although it is preferred to establish the temperature gradient between the upper and lower ends of the article molds 38 by the combined effect of the chill plate 60 and the heating coils, the temperature gradient also could be established by the use of baffles. Thus, a cylindrical baffle could be provided around the lower portion of the circular array of article molds 38. In addition, one or more annular baffles could extend radially inwardly from the cylindrical susceptor 96 to promote the establishment of a temperature gradient. Other baffle arrangements could be used if desired.

Figure 4:
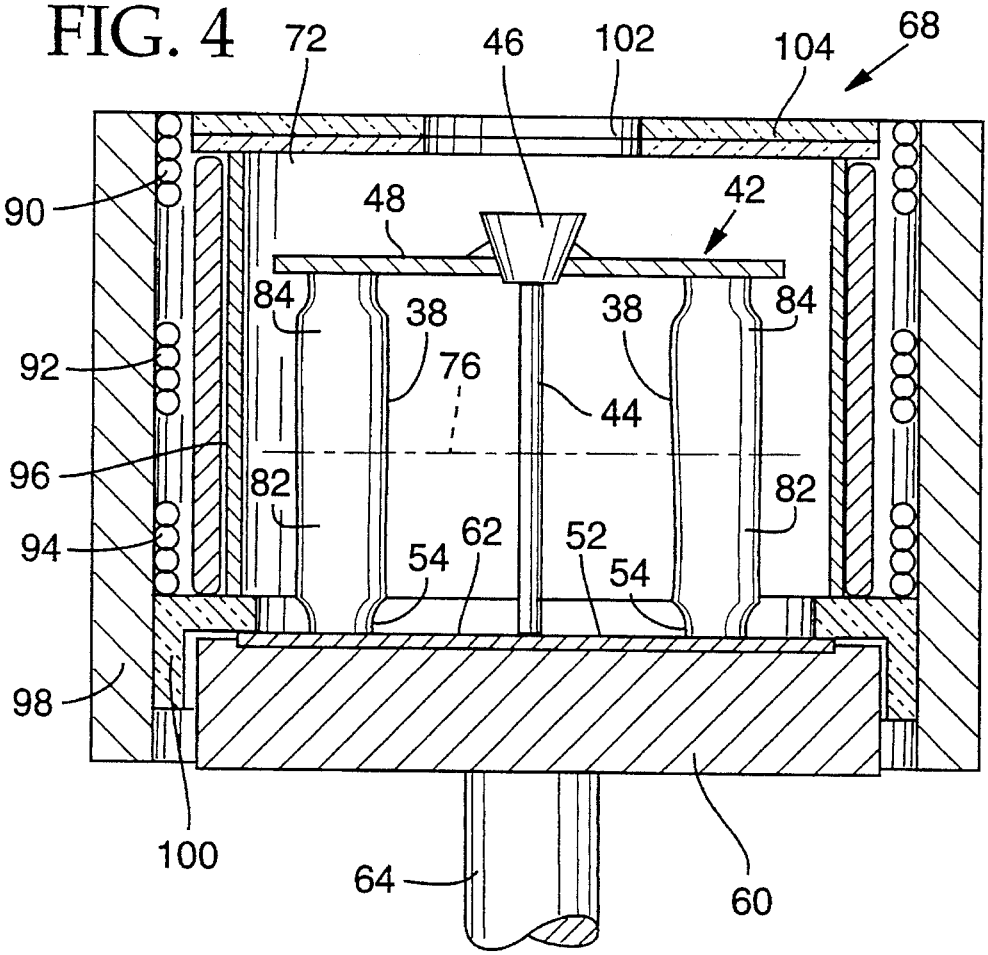
FIG. 4 is a schematic illustration of the manner in which a mold structure for casting a plurality of the articles of FIGS. 1 and 2 is supported on a chill plate in a furnace during preheating and pouring of molten metal into the mold structure.

In the furnace of FIG. 4, coils 90, 92 and 94 are surrounded by a cylindrical furnace wall 98. An annular ceramic ring 100 is disposed adjacent to the lower end of the furnace wall 98. The susceptor 96 is seated on and supported by the ceramic ring 100. Of course, the furnace 68 could have a construction which is different than the specific constructions shown in FIGS. 4 and 9.

Regardless of how the temperature gradient is established, the upper end of a preheated article mold 38 is hotter than the lower end of the article mold. The temperature of the upper end of the long thin portion of a preheated article mold 38 is close to the liquidus temperature of the metal of article 10. The lower end of the long thin portion of the preheated article mold 38 is at a temperature which is approximately 50° to 500° F. less than the temperature of the upper end of the long thin portion of the article mold.

Once the article molds 38 have been preheated in the foregoing manner, molten metal is poured through an opening 102 in a circular upper end wall 104 of the furnace 68 into the pour cup 46. At the time of pouring, the molten metal typically is superheated. As used herein, the term "superheated" refers to heating the alloy to a temperature which is higher than the liquidus temperature by from about 50° F. to about 400° F. The pouring of the molten metal occurs in the vacuum chamber or housing which surrounds the furnace 68. Although it is preferred to fill the article mold cavity from only a single runner or gate 48 connected in fluid communication with the upper end of the article mold cavity, a second runner or gate could be connected with the lower end of the article mold cavity if desired.

Since seventy to one hundred percent of the length of each of the long thin portions of the article molds 38 is below the liquidus temperature of the molten metal, random nucleation occurs over almost the entire surface of each article mold cavity when the molten metal is poured into the article molds. Although the exact extent of nucleation on the surfaces of the article mold cavities is not known, it is believed that nucleation and, therefore, initiation of solidification of the molten metal, occurs at locations which are disposed along at least the lower eighty to ninety percent of the long thin portion of each article mold cavity. This nucleation may be promoted by the presence of an inoculant in the molten metal.

Figure 9:
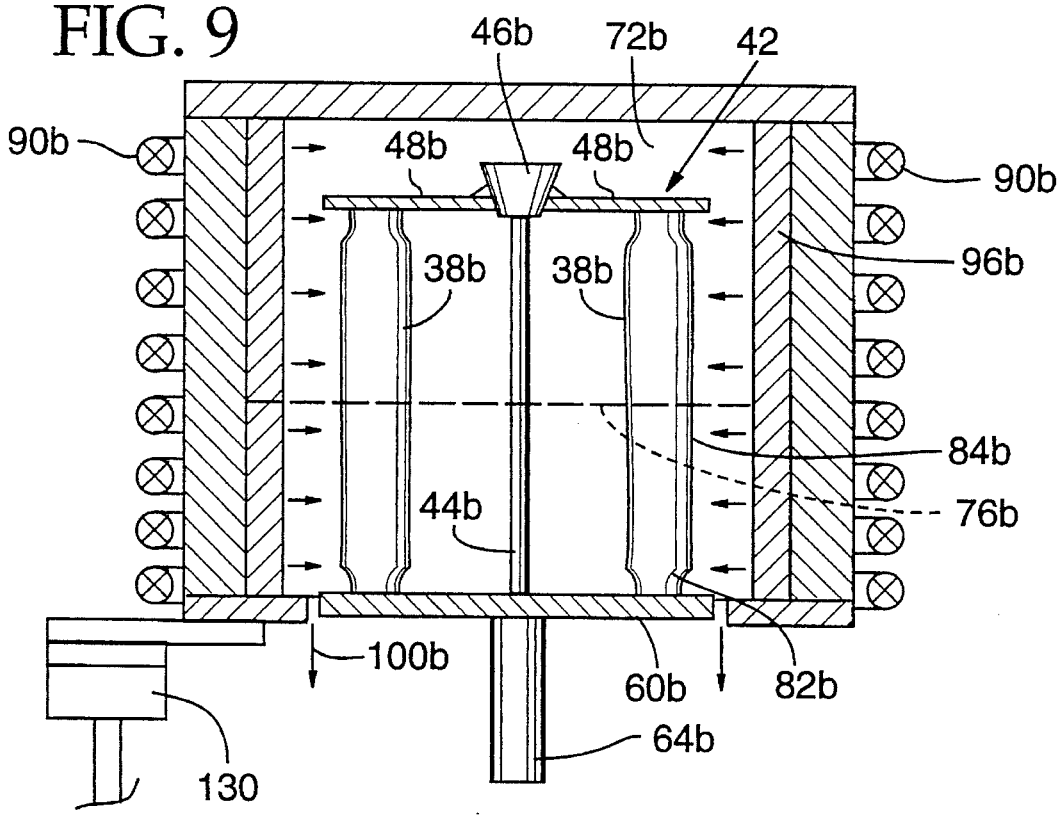
FIG. 9 is a sectional view, generally similar to FIG. 4, illustrating the construction of a third embodiment of the furnace.

With previous inventions, once the article molds 38 were filled with molten metal, the mold slowly was withdrawn from the furnace. However, it is believed that this disturbs the molten metal in the article as it solidifies, which introduces defects into the solidified articles 10. With reference to FIG. 9, rather than moving the mold up and down within a fixed-position mold heater, the heating system may be moved vertically around the mold once the mold is located in the proper pouring position. The heating system may be raised or lowered by any means known in the art. However, the embodiment of the heating system illustrated in FIG. 9 uses an hydraulic system 130 to raise the heating system. This seemingly minor difference offers greatly enhanced repeatability in positioning the heavier mold relative to the heater throughout the heating and cooling cycle, without a corresponding increase in the size and complexity of the motion controlling mechanisms. Thus, a preferred method of practicing the heating and cooling cycles of the present invention comprises moving the heating system, such as a mold furnace, while maintaining the molds 38 steady.

As soon as the article molds 38 are filled with molten metal, the withdrawal of the furnace 68 from around the mold structure 42 (or vice versa) begins. The rate of withdrawal of the furnace 68 from around the mold structure 42 is significantly slower than the withdrawal rates taught by U.S. Pat. No. 4,809,764. This patent teaches withdrawal rates of only as low as about 60 to 120 inches per hour. However, significantly slower mold withdrawal speeds have been found necessary to produce articles having substantially no defects for certain metal alloy compositions and for certain part configurations. Although the rate of withdrawing the furnace 68 may vary, it has surprisingly been found that withdrawal rates as low as about 0.10 inch per minute to 0.50 inch per minute (about 7.0 inches per hour to about 30 inches per hour) provide much better solidification results, as determined by radiographic analysis of the cast metal article.

Figure 5:
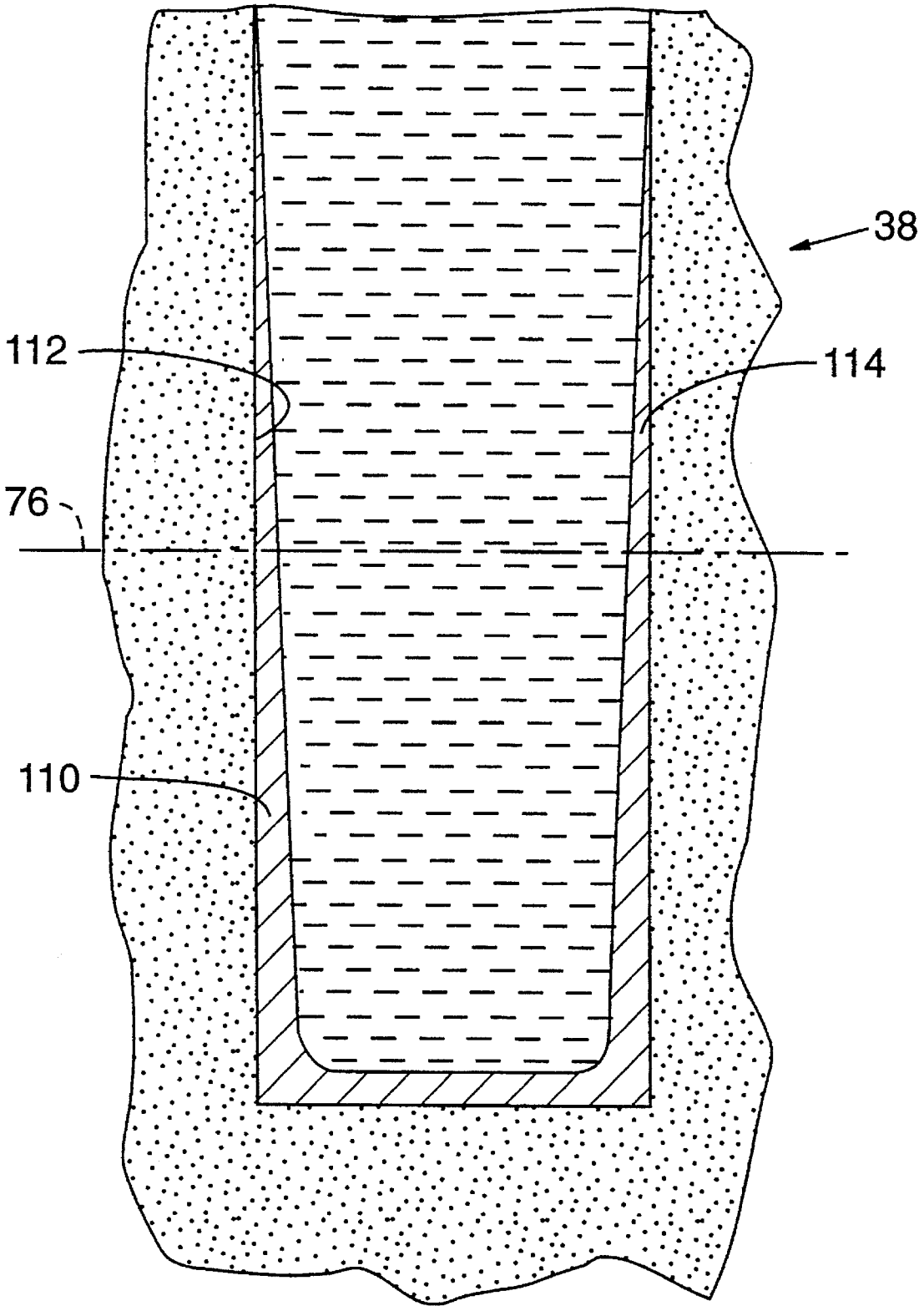
FIG. 5 is a schematicized sectional view of an article mold cavity of the mold structure of FIG. 4 and illustrating the manner in which molten metal initially solidifies along a large majority of the surface area of the long thin portion of the article mold cavity.

As furnace 68 is withdrawn from around an article mold 38, a thin, discontinuous layer or skin 110 (FIG. 5) of equiaxed metal solidifies over a large majority of an inner side surface 112 of the long thin portion of an article mold cavity 114. Although it can only be hypothesized, and hence without limiting the invention to one theory of operation, it is believed that the thin layer 110 extends over all but the upper two to ten percent of the inner side surface 112 of the long thin portion of the article mold cavity 114. The metal layer 110 has an equiaxed grain structure (FIG. 3) with a maximum grain dimension of one half of an inch or less. Of course, the inner side surface 112 of the long thin portion of the article mold cavity 114 and the metal layer 110 have a configuration which corresponds to the configuration of the long thin portion of the article to be cast, that is, the portion 16 of the seals 10.

As the furnace 68 is withdrawn from around mold structure 42 (FIG. 4) dendrites grow inwardly and upwardly from the thin skin 110 extending over the side surface 112 (FIG. 5) of the long thin portion of the mold cavity 114. However, the thin skin or layer 110 does not initially extend over the single inlet to the article mold cavity 114. Therefore, molten metal can be fed from a runner 48 into an article mold cavity 114. Dendrites appear to grow upwardly from the thin skin 110 at a faster rate than they grow inwardly from the thin skin 110.

If furnace 68 is withdrawn vertically upwardly from around article mold 38, molten metal solidifies faster in the lower half 82 of the long thin portion of the article mold than in the upper half 84 of the long thin portion article mold. This would be reversed, of course, if the furnace was withdrawn vertically downwardly. This faster metal solidification in the lower half 82 of the long thin portion of the article mold is due to the combined effects of: (1) preheating the lower half 82 to a lower temperature than the upper half 84; (2) having the closed lower end of the article mold adjacent to the chill plate 60; and (3) withdrawing furnace 68 from around the lower end portion of the article mold 38 and exposing this portion of the mold to the relatively cool environment of the vacuum chamber surrounding the furnace 68. Therefore, the molten metal in the article mold cavity 114 solidifies, with an equiaxed grain structure, upwardly from the bottom of the mold cavity at a greater rate than it solidifies inwardly from the upright sides of the article mold cavity.

Figure 6:
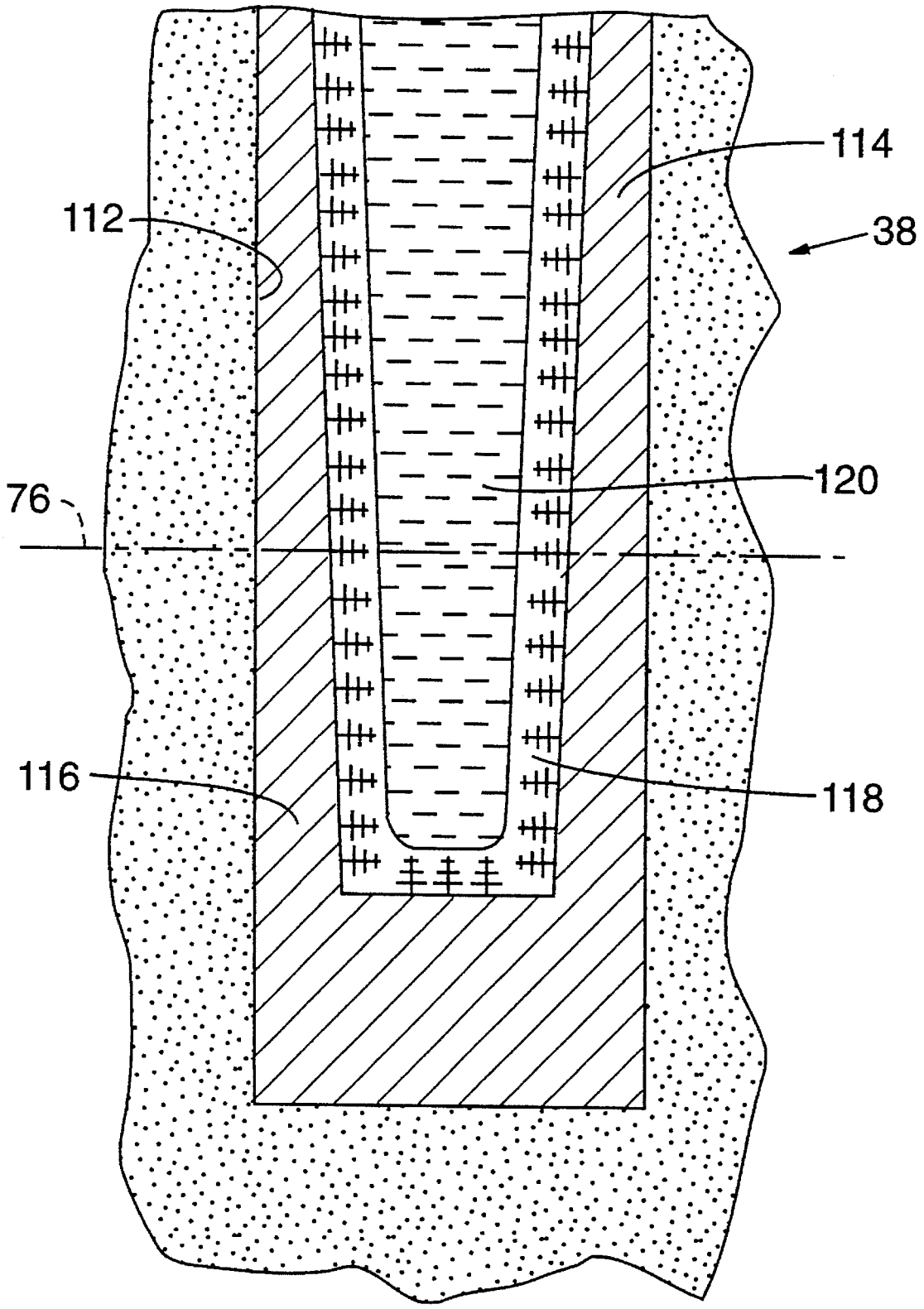
FIG. 6 is a schematic sectional view, generally similar to FIG. 5, illustrating the manner in which the molten metal simultaneously solidifies upwardly from the bottom of the long thin portion of the mold cavity and inwardly from the sides of the mold cavity.

As the molten metal solidifies in the long thin portion of the article mold cavity 114 (FIG. 6), a solid zone 116 is formed at the lower end and along the sides of the long thin portion of the article mold cavity. A mushy zone 118 (FIG. 6) of partially molten, partially solidified metal is located inwardly of the mushy zone 118 and is disposed along the central axis of the long thin portion of the article mold cavity 114. The liquid zone 120 extends upwardly to the opening to a runner or gate 48.

Figure 7:
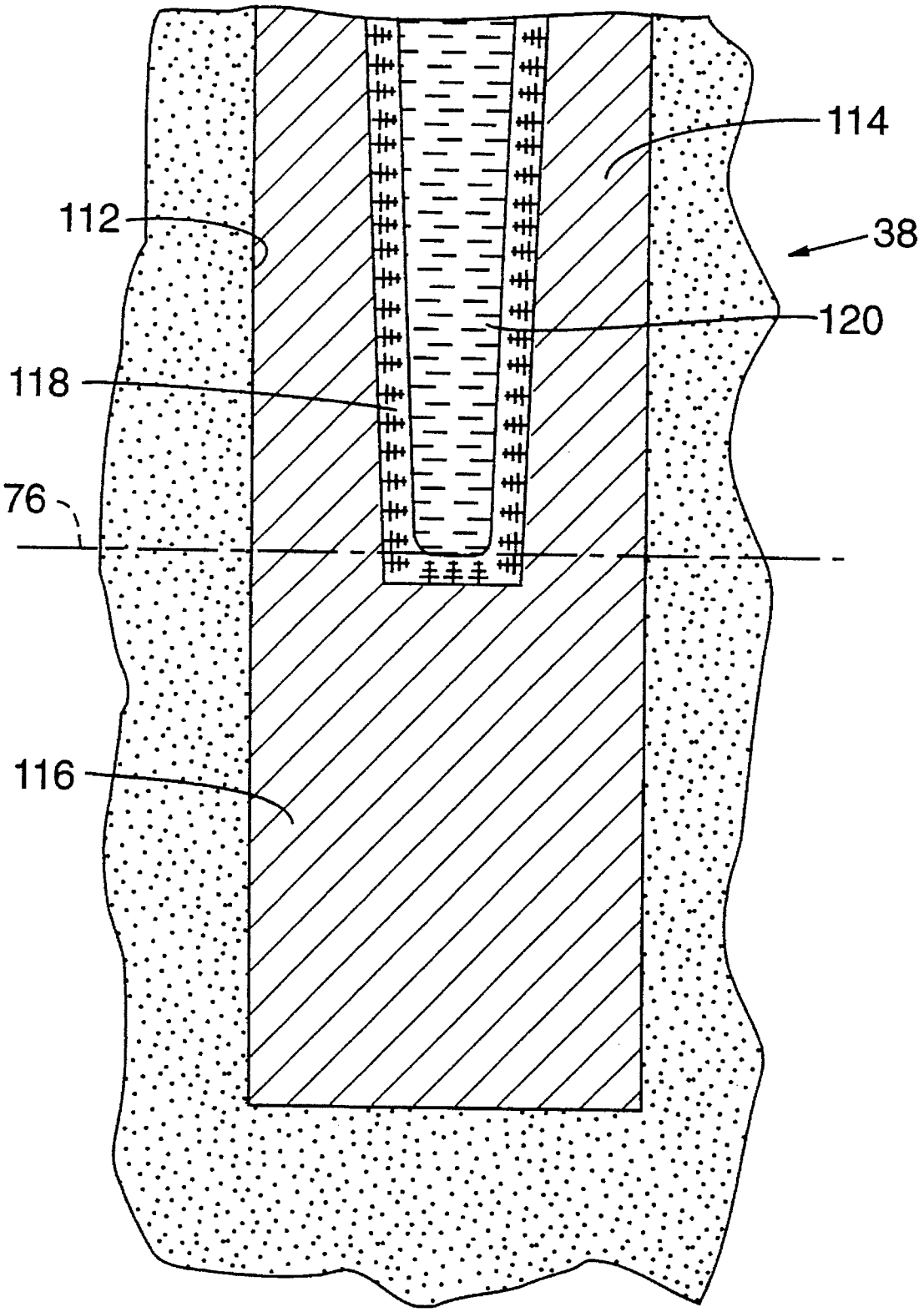
FIG. 7 is a schematic sectional view, generally similar to FIG. 6, illustrating the manner in which the molten metal solidifies in the lower portion of the long thin portion of the article mold cavity before the metal solidifies in the upper portion of the article mold cavity.

Although dendrites will extend from the thickening layer of solidified metal on the upright sides of the long thin portion of the article mold cavity 114 into the mushy zone 118, molten metal can be fed from a runner 48 into the mushy zone to compensate for shrinkage as the molten metal in the mold cavity 114 solidifies. As solidification continues, the size of the mushy zone 118 decreases (FIG. 7) and the amount of solidified molten metal in the lower half of the long thin portion of the article mold cavity 114 increases. Due to the effect of the relatively cold chill plate 60, the relatively hot molten metal in the pour cup 46 and runner 48, and the temperature gradient established during preheating of the mold, the shrinking mushy zone 118 moves upwardly along the vertical longitudinal central axis of the long thin portion of the article mold cavity 114.

As furnace 68 continues to be withdrawn from around the article mold 38, the mushy zone 118 will move upwardly at a greater rate than it moves inwardly from the upright sides of the long thin portion of the article mold cavity 114. This enables the molten metal to solidify in the article mold cavity without the formation of voids or other defects. When solidification of the molten metal in the lower half of the long thin portion of the article mold cavity has been completed, the solidification of the molten metal in the upper half of the long thin portion of the article mold cavity will not have been completed. However, when solidification of the molten metal in the lower half of the long thin portion of the article mold cavity has been completed, the majority of the molten metal in the upper half of the long thin portion of the article mold cavity will have solidified. It is estimated that when solidification of the molten metal in the lower half of the long thin portion of the article mold cavity is completed, approximately seventy to eighty five percent of the molten metal in the upper half of the long thin portion of the article mold cavity will have solidified.

Solidification progresses from the lower end of the long thin portion of the article mold cavity 114 to the upper end of this portion of the mold cavity. The feeding of molten metal to compensate for shrinkage occurs along the central axis of the article as the metal solidifies. This technique controls solidification such that it keeps open a central channel 120 inside the solidified metal 116 through which molten metal can feed from top runners 48 to compensate for solidification contraction that occurs in remote lower sections.

This technique also actively promotes the availability of transverse secondary interdendritic channels for required lateral feeding of solidifying sections. Transverse interdendritic feeding depends primarily on the length of the interdendritic channels, which are generally determined by the dimensions of the mushy zone 118. Since the width of the mushy zone 118 is inversely related to the prevailing temperature gradients, the positive temperature gradients continually reduce the width of the mushy zone in the solidifying sections and thereby promote effective interdendritic lateral feeding.

After the furnace 68 has been completely withdrawn from around mold structure 42, the cooling of the mold structure and the metal therein is completed. The ceramic material of the mold is thereafter removed from the solidified metal. The metal which solidified in the article molds 38 will have an equiaxed grain structure and an overall configuration which corresponds to the configuration of articles 10. Since there are no gates to supply molten metal to the article mold cavity 114 at locations along the longitudinal central axis of the article mold cavity, the long thin portion 16 of the cast articles 10 will be free of gating material. Of course, long thin metal articles other than articles 10 can be cast with an equiaxed grain structure by using the foregoing method.

D. Furnace-Second Embodiment

Figure 8:
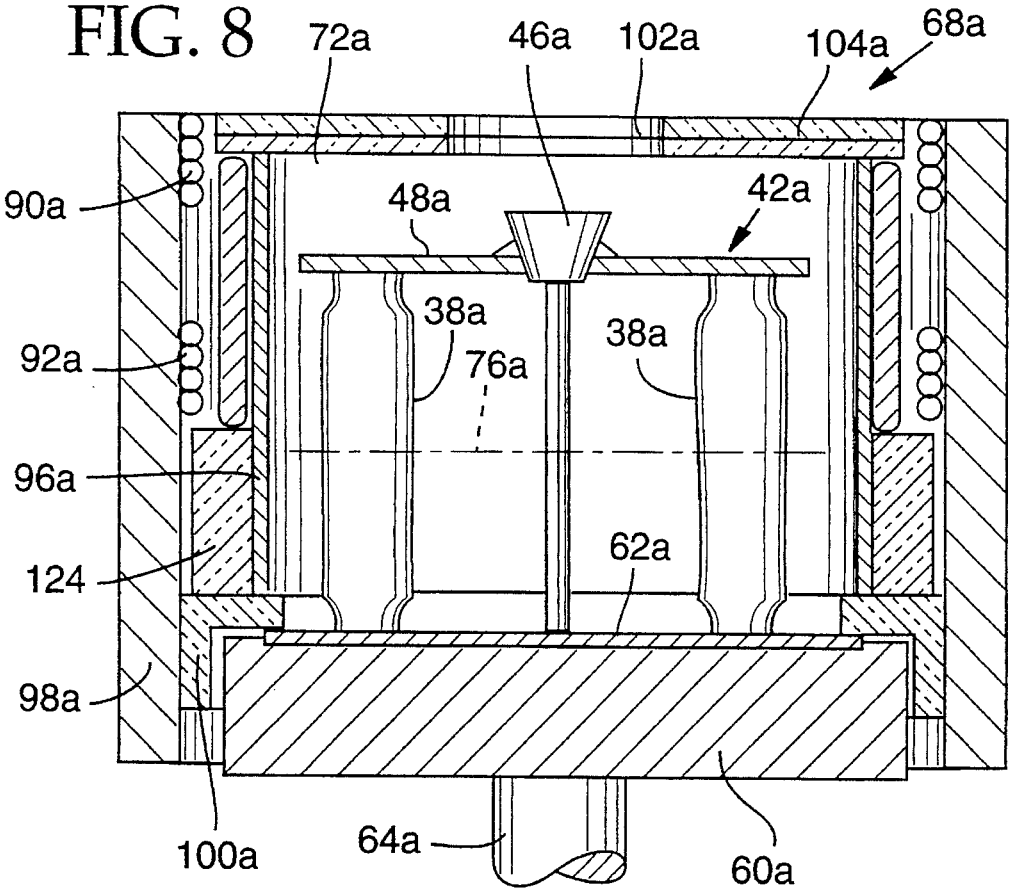
FIG. 8 is a sectional view, generally similar to FIG. 4, illustrating the construction of a second embodiment of the furnace.

The embodiment of the furnace 68 illustrated in FIG. 4 includes coils 90, 92 and 94 to control both the heating of the mold 42 and to help produce temperature gradients in the mold as furnace 68 is withdrawn. In the embodiment of the furnace illustrated in FIG. 8, two coils, 90*a* and 92*a*, are used. Since the embodiments of the furnace illustrated in FIGS. 8 and 9 are generally similar to the embodiment of the furnaces illustrated in FIG. 4, similar numerals will be utilized to designate similar components. To avoid confusion, the suffix letter "a" is associated with the numerals in FIG. 8, and the suffix "b" is associated with the numerals in FIG. 9.

As illustrated in FIG. 8, furnace 68*a* is used during the heating of a mold structure 42*a*. The furnace 68*a* has an upper coil 90*a* and a lower coil 92*a*. The susceptor 96*a* ends immediately below the lower coil 92*a*. A cylindrical ceramic spacer block 124 is provided below the coil 92*a* in the position occupied by the coil 94 in the embodiment of the furnace illustrated in FIG. 4. Elimination of the lower coil and substituting a ceramic spacer block 124 makes it easier to heat the mold assembly 42*a* and obtain a temperature gradient which extends from the relatively cool lower half 82*a* of an article mold 38*a* to a relatively hot upper half 84*a* of the article mold.

The omission of the lower coil, corresponding to the coil 94 of FIG. 4, results in the induction coils 90*a* and 92*a* circumscribing only about 50 percent of the length of the portion of the article mold 38*a* in which the article mold cavity is disposed. Thus, the coils 90*a* and 92*a* circumscribe only the portion of the mold structure 42*a* which is above the plane 76*a*. Therefore, less than 75% of the article mold cavity is surrounded by induction coils. The lower half of the article mold cavity is circumscribed by the annular ceramic spacer block 124.

E. Casting a Metal Article

Article 10 of FIGS. 1–2 may be formed from a variety of metal-alloy compositions. The solidification process for each process may differ. U.S. Pat. No. 4,809,764 teaches making vanes, which have different configurations and thermal soundness requirements than seals. The vane discussed in the '764 patent was made from a nickel-chromium superalloy, such as IN-713C or Rene 77, having a solidus temperature of more than 2,250° F. The '764 patent teaches heating article molds 38 so that the lower half 82 of the long thin portion of each article mold 38 has an average temperature of less than 2,250° F. The upper half 84 of the long thin portion of each article mold 38 is heated to an average temperature of close to or slightly above the solidus temperature of the metal. The molten nickel-chromium superalloy is heated to a temperature above 2,400° F. before being poured.

The present invention will be illustrated by the following examples. These examples are provided for purposes of illustrating specific embodiments of the invention, and should not be considered in any way to limit the invention to the specific features described herein.

EXAMPLE 1

This example describes a prior-art process from U.S. Pat. No. 4,809,764. The process was used to make a vane from a nickel-chromium alloy. In one specific instance taught by the '764 patent, the vane was formed of Rene 77 having a liquidus temperature of 2,450° F. and a solidus temperature of 2,310° F. The mold structure 42 was preheated so that the closed lower ends of the article molds 38 were at a temperature of approximately 1,850° F., and the upper ends of the article molds were at a temperature of approximately 2,250° F. Hence, in the specific example provided in the '764 patent, the highest temperature in the second temperature range is below the solidus temperature of the metal.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38 to 2,250° F. at the upper ends of the long thin portions of the article molds, the molten metal was poured into the pour cup 46.

The molten metal ran through the runners 48 into the article mold cavities 38. As the article molds 38 were filled with molten metal, it is believed that nucleation occurred at various locations along approximately 95% of the longitudinal extent of the long thin portion of the article mold cavity. As soon as the article mold cavities 38 were filled with molten metal, the chill plate 60 was lowered to begin withdrawal of the mold structure 42 from the furnace 68 at a rate of 60 inches per hour. As the mold structure 42 started to be withdrawn from the furnace 68, the electrical energy supplied to the coils 90, 92 and 94 was interrupted.

The vane 10 was cast without any gating along the longitudinal extent of the article mold cavity. The vane 10 had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one fourth of an inch.

EXAMPLE 2

This example describes efforts to make the long thin parts contemplated by the present invention from a cobalt-chromium alloy. Furnace withdrawal rates significantly slower than those taught by the '764 patent were used. Nevertheless, the metal article still included defects.

Specifically, a cobalt-chromium alloy, designated MAR-M-509 by the supplier, was selected. The major constituents of this alloy are nickel (10 weight percent), chromium (23.5 weight percent), and cobalt (55 weight percent). This composition has a solidus temperature of about 2,381° F, and a liquidus temperature of about 2,587° F. The cobalt-chromium composition was heated to a pour temperature of about 2,750° F.

The mold structure 42 was preheated in a furnace, such as that shown in FIG. 9, so that the mold temperature at the top of the mold was about 2,475° F., and the temperature at the bottom of the mold was about 2,286° F. For the present example, an inoculant was used to promote nucleation. The molten metal ran through the runners 48 and into the mold cavities 38. As soon as the article mold cavities 38 were filled with molten metal, the furnace was withdrawn from round the mold at an initial withdrawal rate of about 0.25 inch per minute (15 inches per hour). This withdrawal rate was maintained for a period of about 16 minutes. Thereafter, the withdrawal rate was increased to about 0.50 inch per minute (30 inches per hour), and this rate was maintained for a period of about 10 minutes. Thus, the fastest withdrawal rate practiced for this example was only about 30 inches per hour, as compared to the 60 inches per hour taught by the '764 patent. The article was cast without using any gates along the entire length of the long and thin portion of the article.

When the metal had completely solidified, the article was subjected to radiographic analysis. This analysis showed that the soundness requirements for very thin-walled cast shapes needed for competitively priced, light-weight, fuel efficient gas turbine engines were not met by the cast product.

EXAMPLE 3

This example describes the formation of a seal, such as seal 10, from the cobalt-chromium alloy designated MAR-M-509. This is the same alloy as used in example 2, which has an approximate solidus temperature of about 2,381° F., and an approximate liquidus temperature of about 2,587° F. The MAR-M-509 composition was heated to a pour temperature of about 2,750° F.

The mold structure 42 was preheated in a furnace, such as that shown in FIG. 9, so that the mold temperature at the top of the mold was about 2,475° F., and the temperature at the bottom of the mold was about 2,286° F. For the present example, an inoculant was used to promote nucleation. The molten metal ran through the runners 48 and into the mold cavities 38. As soon as the article mold cavities 38 were filled with molten metal, the furnace was withdrawn from round the mold at a withdrawal rate of about 0.25 inch per minute (15 inches per hour). This withdrawal rate was maintained for a period of greater than 40 minutes. The article was cast without using any gates along the entire length of the long and thin portion of the article.

When the metal had completely solidified, the article was subjected to radiographic analysis. This analysis showed that the soundness requirements for very thin-walled cast shapes needed for competitively priced, light-weight, fuel efficient gas turbine engines were met by the cast product. One possible reason for this is that the mold withdrawal rate was at least as low as 0.25 inch per minute throughout the entire solidification process. With Example 2, the solidification process included a period during which the mold withdrawal rate was as high as about 0.5 inch per minute.

EXAMPLE 4

This example describes the formation of a seal using the process of the present invention. The alloy used for this example was a Ni-Cr alloy, which is designated as IN 738. This alloy has a melt range of from about 2,250° to about 2,400° F. The composition of this alloy, in weight percent, is about 61 percent Ni, 16 percent Cr and 8.5 percent Co. The general methods described above in Example 2 were used in this example. The pour temperature was about 2,600° F. The mold temperature of the upper half of the long portion of the mold has a temperature of at least about 2,375° F.

However, in this example the furnace withdrawal rate was decreased to be about 0.125 inch per minute (7.5 inches per hour). Withdrawal of the furnace was continued at this rate for a period of about 40 minutes. When the casting procedure was completed, the cast metal article was subjected to radiographic analysis. This analysis indicated that the metal article was substantially free of defects. Thus, this procedure produced a suitable cast metal article when procedures closer to, but different, from that of the '764 patent failed.

Thus, based on the examples provided herein, the mold withdrawal rates taught by the '764 patent are entirely too fast when casting materials out of alloy compositions other than those specifically taught by the patent. More specifically, it appears that a withdrawal rate of less than about 30 inches per hour, preferably less than about 15 inches per hour, and even more preferably less than about 7.5 inches per hour, provides a superior casting process, at least for certain compositions, when compared to the process taught by the '764 patent.

EXAMPLE 5

This example describes the possible production of a part using a furnace withdrawal rate of as fast as about 0.50 inch per minute (30 inches per hour). To practice this example, any superalloy suitable for the invention could be selected, such as Rene 41. Rene 41 has a solidus temperature of about 2,400° F. and a liquidus temperature of about 2,500° F. The composition of this alloy is about 55 percent nickel, 11 percent cobalt, 19 percent chromium and 10 percent Mo. The procedures for the formation of the mold and for heating the mold in the furnace are described above.

Rene 41 likely would be poured at a superheated temperature of greater than about 2,550° F. The mold would be heated in a furnace, such as that illustrated in FIG. 9, so that the upper half of the portion of the mold that defines the long thin portion of the mold cavity is heated as close to the liquidus temperature as possible, such as heating this portion of the mold to a temperature of greater than about 2,450° F. The molten Rene 41 would then be poured into the mold. Thereafter, the mold could be withdrawn from the furnace at a rate approaching about 30 inches per hour. This procedure should still provide an article that is substantially free of defects as determined by radiographic analysis. One key consideration in increasing the rate of withdrawal of the mold to rates approaching 30 inches per hour appears to be heating the upper half of the portion of the mold that defines the long thin portion of the mold cavity to a temperature that is close to the liquidus temperature, such as less than about 50° F. less than the liquidus temperature.

F. Determining G/R Ratios

The ratio of the temperature gradient (G) to the rate of solidification or rate of furnace withdrawal (R) [G/R ratio] provides an important indicator for determining an acceptable solidification rate for casting a particular metal composition. The concept of the G/R ratio is known to those skilled in that art and also is described briefly in U.S. Pat. No. 4,724,891, which is incorporated herein by reference. However, the '891 patent provides no specific reference to casting long and thin metal seals. It now has been determined that casting metal articles according to the present invention is facilitated by casting the metal article in such a manner as to insure that the G/R ratio is from about 100 to about 11,000, and even more preferably from about 450 to about 11,000.

EXAMPLE 6

This example describes a procedure that was used to measure the G/R ratio. A mold was first made as described above that was configured in the shape of a desired seal, such as seal 10. Thermocouples were placed inside the mold at various heights. The thermocouples were connected to a controller which samples the temperature of each thermocouple at one second intervals. These temperatures were recorded during the furnace withdrawal process.

The mold was preheated as described above and then a superheated cobalt chromium alloy, MAR-M-509 (10 percent Ni, 23.5 percent Cr, and 55 percent cobalt), was added to the mold from the pour cup. MAR-M-509 has a solidus temperature of about 2,381° F., and a liquidus temperature of about 2,587° F. After the metal was poured, the furnace was withdrawn from around the mold using a furnace withdrawal rate of about 0.25 inch per minute. The mold thereafter began to cool, and readings from the thermocouples were recorded. These readings were continued throughout the solidification process. Once the metal begins to solidify, i.e. as the temperature of the metal begins to approach the solidus temperature, then controlling the G/R ratio becomes more important for obtaining a cast metal seal that is substantially free of defects.

For the present example, the solidus temperature is about 2,370° F. As this temperature was approached, the temperatures was recorded for each of the thermocouples at one second intervals. Once this data had been collected, the G/R ratios were calculated. This calculation is known to those skilled in the art.

By using the procedure described in Example 4 to cast metal articles, it has been determined that a G/R ratio of than about 100, preferably greater than about 450, and typically from about 450 to about 11,000, provides a cast metal article that is substantially free of defects as determined by radiographic analysis. It will be understood by those skilled in the art that the rate of solidification is influenced by the withdrawal rate of the furnace (or, alternatively, the withdrawal rate of the mold from the furnace). Thus, as the rate of withdrawal decreases, the value of R also decreases, which increases the value of the G/R ratio. However, once a certain G/R ratio is exceeded, the metal will undesirably solidify in a columnar grain structure, rather than in an equiaxed grain structure. Although this certain G/R ratio may vary based on, for instance, the alloy composition and the configuration of the cast metal article, it has been determined that casting long and thin metal articles with an equiaxed grain structure is facilitated by maximizing the G/R ratio below a value of about 11,000.

G. Conclusion

The present invention relates to a new and improved method of casting a metal article which is long and thin, or which has a long thin portion, and an equiaxed grain structure. The article is cast in a mold cavity having a configuration corresponding to the configuration of the article. The article mold cavity is free of gating and risers between opposite ends of the long thin portion of the mold cavity. Thus, there are no gates or risers along the length of the long thin portion of the mold cavity.

The mold is preheated so that a lower half of the portion of the article mold in which the long thin portion of the article is cast is at a temperature which is close to but less than the solidus temperature of the metal of the article. The upper half of the portion of the mold in which the long thin portion of the article is cast is heated to a temperature which is close to the liquidus temperature of the metal. Molten metal is conducted into the article mold cavity through an inlet from a gate or runner at the upper end of the article mold cavity and is solidified with an equiaxed grain structure (FIG. 3). If desired, a second gate could be provided at the lower end of the article mold.

The molten metal in the lower half of the portion of the mold cavity in which the long thin portion of the article is cast is completely solidified before the molten metal in the upper half of this portion of the mold cavity is completely solidified. G/R ratios of greater than about 100, preferably greater than about 450, facilitate obtaining a cast metal article that is substantially free of defects. G/R ratios within this range are obtained by using furnace withdrawal rates of from about 7.5 inches per hour to about 30 inches per hour. During solidification of the molten metal with an equiaxed grain structure, decreases in the volume of the metal are compensated for by feeding metal to the long thin portion of the article mold cavity through the inlet through which molten metal was originally conducted to the long thin portion of the article mold cavity.

Having illustrated and described the principles of the invention in several preferred embodiments, it should be apparent to those skilled in the art that the invention can be modified in arrangement and detail without departing from such principles. We claim all modifications coming within the spirit and scope of the following claims.

I claim:

1. A method for casting metal articles, comprising the steps of:

forming a mold having a mold cavity, the mold cavity having a long thin portion which has a length of more than about four inches and which is at least about twenty times its thickness, the long thin portion of the mold cavity being free of gating along its length;

positioning the mold in a furnace so that the furnace substantially surrounds the mold and so that a longitudinal axis of the long thin portion of the mold cavity is in an upright orientation;

heating the mold with the furnace, the step of heating the mold including heating a lower half of the portion of the mold that defines the long thin portion of the mold cavity into a first temperature range, and heating an upper half of the portion of the mold defining the long thin portion of the mold cavity into a second temperature range, the highest temperature of the first temperature range being close to but less than the solidus temperature of the metal, and the highest temperature of the second temperature range being close to the liquidus temperature of the metal;

conducting molten metal into the mold cavity at a location other than along the length of the long thin portion of the mold cavity while the lower half of the portion of the mold defining the long thin portion of the mold cavity is in the first temperature range, and while the upper half of the portion of the mold defining the long thin portion of the article mold cavity is in the second temperature range; and moving the mold and furnace relative to another at a rate of less than about 30 inches per hour to solidify the molten metal in the article mold cavity with an equiaxed grain structure.

2. The method according to claim 1 wherein the metal is a superalloy.

3. The method according to claim 1 wherein the metal is selected from the group consisting of nickel chromium superalloys, cobalt chromium superalloys and iron chromium superalloys.

4. The method according to claim 3 wherein the metal is a cobalt chromium superalloy and the article is a seal.

5. The method according to claim 1 wherein the step of solidifying the metal includes withdrawing the furnace from around at least that portion of the mold which defines the long thin portion of the cavity at a rate that is less than about 15 inches per hour.

6. The method according to claim 1 wherein the step of solidifying the metal includes withdrawing the furnace from around the entire portion of the mold defining the long thin portion of the cavity at a rate that is from about 7 inches per hour to about 30 inches per hour.

7. The method according to claim 1 wherein the metal is a cobalt chromium superalloy having a solidus temperature of about 2370° F. and a liquidus temperature of about 2580° F., the step of conducting molten metal into the article mold cavity including conducting a superheated molten cobalt chromium superalloy into the article mold cavity, the step of heating a lower half of the portion of the mold defining the long thin portion of the article mold cavity including heating the lower half of the portion of the mold defining the long thin portion of the article mold cavity to an average temperature of less than about 2,300, and heating an upper half of the portion of the mold defining the long thin portion of the article mold cavity to an average temperature of about 2475° F.

8. The method according to claim 7 and wherein the step of solidifying the metal includes the step of withdrawing the furnace from around the mold at a rate of less than about 15 inches per hour.

9. The method according to claim 1 wherein the step of conducing molten metal into the article mold cavity includes conducting molten metal into the long thin portion of the article mold cavity at only one end of the long thin portion of the article mold cavity.

10. The method according to claim 1 wherein the step of solidifying the metal includes the step of withdrawing the furnace at a rate selected to provide a G/R ratio of greater than about 450.

11. A method of casting a metal article, comprising the steps of:

forming a mold having an article mold cavity, the mold cavity having a long thin portion which has a length of more than about four inches and at least about twenty times its thickness, the long thin portion of the mold cavity being free of gating along its length;

positioning the mold in a furnace so that the furnace substantially surrounds the mold and so that a longitudinal axis of the long thin portion of the mold cavity is in an upright orientation;

heating the mold with the furnace, the step of heating the mold including heating a lower half of the portion of the mold that defines the long thin portion of the mold cavity into a first temperature range wherein the highest average temperature in the first range is less than about 2,300° F., the step of heating the mold including heating an upper half of the portion of the mold defining the long thin portion of the mold cavity into a second temperature range which is greater than the first temperature range, the highest temperature of the second temperature range being close to the liquidus temperature of the metal;

conducting molten metal into the mold cavity at a location other than along the length of the long thin portion of the mold cavity while the lower half of the portion of the mold defining the long thin portion of the mold cavity is in the first temperature range, and while the upper half of the portion of the mold defining the long thin portion of the article mold cavity is in the second temperature range;

withdrawing the furnace from around the mold containing the molten metal by moving the furnace and the mold relative to one another at a rate of less than about 30 inches per hour; and solidifying the molten metal in the article mold cavity with an equiaxed grain structure.

12. The method according to claim 11 wherein the metal is a superalloy.

13. The method according to claim 11 wherein the metal is selected from the group consisting of nickel chromium superalloys, cobalt chromium superalloys and iron chromium superalloys.

14. The method according to claim 13 wherein the metal alloy is selected from the group consisting of cobalt chromium superalloys and iron chromium superalloys.

15. The method according to claim 11 wherein the metal is a cobalt chromium superalloy and the article is a seal.

16. The method according to claim 11 wherein the furnace is withdrawn from around the mold at a rate of less than about 15 inches per hour.

17. The method according to claim 11 wherein the step of conducing molten metal into the article mold cavity includes conducting molten metal into the long thin portion of the article mold cavity at only one end of the long thin portion of the article mold cavity.

18. The method according to claim 11 wherein the step of solidifying the metal includes the step of withdrawing the furnace at a rate selected to provide a G/R ratio of greater than about 450.

19. A method of casting a long and thin metal seal with an equiaxed grain structure, comprising the steps of:

forming a mold having an article mold cavity configured in the shape of the seal, the mold cavity having a long thin portion which has a length of more than about four inches and at least twenty times its thickness, the long thin portion of the mold cavity being free of gating along its length;

positioning the mold in a furnace so that the furnace substantially surrounds the mold and so that a longitudinal axis of the long thin portion of the mold cavity is in an upright orientation;

heating the mold with the furnace, the step of heating the mold including heating a lower half of the portion of the mold that defines the long thin portion of the mold cavity into a first temperature range of less than about 2,300° F., and an upper half of the portion of the mold defining the long thin portion of the mold cavity into a second temperature range that is close to the liquidus temperature of the metal alloy;

providing a superheated molten metal selected from the group consisting of metal superalloys;

conducting the molten metal superalloy into the mold cavity at a location other than along the length of the long thin portion of the mold cavity and at only one end of the long thin portion of the article mold cavity while the lower half of the portion of the mold defining the long thin portion of the mold cavity is in the first temperature range, and while the upper half of the portion of the mold defining the long thin portion of the article mold cavity is in the second temperature range;

withdrawing the furnace from around the mold at a rate which is from about 7 inches per hour to about 30 inches per hour, and wherein the rate is selected to provide a G/R ratio of greater than about 450; and solidifying the molten metal in the article mold cavity with an equiaxed grain structure.

20. The method according to claim 19 wherein the metal alloy is a cobalt chromium superalloy having from about 45 to about 75 weight percent cobalt and a liquidus temperature of about 2580° F., the step of heating the mold into a second temperature range comprising heating the mold to a temperature of about 2475° F.

21. A method for casting metal articles, comprising:

forming a mold having a mold cavity, the mold cavity having a long thin portion which has a length of more than about four inches and which is at least about twenty times its thickness, the long thin portion of the mold cavity being free of gating along its length;

positioning the mold in a furnace so that the furnace substantially surrounds the mold with a longitudinal axis of the long thin portion of the mold cavity being in an upright orientation;

heating the mold with the furnace, the step of heating the mold including heating a lower half of the portion of the mold that defines the long thin portion of the mold cavity into a first temperature range, and heating an upper half of the portion of the mold defining the long thin portion of the mold cavity into a second temperature range, the highest temperature of the first temperature range being close to but less than the solidus temperature of the metal, and the second temperature range being above the solidus temperature and close to the liquidus temperature of the metal;

conducting molten metal into the mold cavity at a location other than along the length of the long thin portion of the mold cavity while the lower half of the portion of the mold defining the long thin portion of the mold cavity is in the first temperature range, and while the upper half of the portion of the mold defining the long thin portion of the article mold cavity is in the second temperature range; and moving the mold and furnace relative to one another to cause the molten metal to solidify in the article mold cavity with an equiaxed grain structure.

22. A method for casting metal articles, comprising:

forming a mold having a mold cavity, the mold cavity having a long thin portion which has a length of more than about four inches and which is at least about twenty times its thickness, the long thin portion of the mold cavity being free of gating along its length;

positioning the mold in a furnace so that the furnace substantially surrounds the mold with a longitudinal axis of the long thin portion of the mold cavity being in an upright orientation;

heating the mold with the furnace, the step of heating the mold including heating a lower half of the portion of the mold that defines the long thin portion of the mold cavity into a first temperature range, and heating an upper half of the portion of the mold defining the long thin portion of the mold cavity into a second temperature range, the highest temperature of the first temperature range being close to but less than the solidus temperature of the metal, and the highest temperature of the second temperature range being within about 100° F. of the liquidus temperature of the metal;

conducting molten metal into the mold cavity at a location other than along the length of the long thin portion of the mold cavity while the lower half of the portion of the mold defining the long thin portion of the mold cavity is in the first temperature range, and while the upper half of the portion of the mold defining the long thin portion of the article mold cavity is in the second temperature range; and moving the mold and furnace relative to one another to cause the molten metal to solidify in the article mold cavity with an equiaxed grain structure.

23. The method according to claim 22 wherein the highest temperature of the second temperature range is within about 50° F. of the liquidus temperature of the metal.

24. The method according to claim 22 wherein the highest temperature of the second temperature range is within about 25° F. of the liquidus temperature of the metal.

25. The method according to claim 22 wherein the highest temperature of the second temperature range is substantially equal to the liquidus temperature of the metal.

26. The method according to claim 22 wherein the step of moving the mold and furnace comprises moving the mold and furnace relative to another at a rate of less than about 30 inches per hour to cause the molten metal so solidify in the article mold cavity with an equiaxed grain structure.

27. The method according to claim 22 wherein the step of moving the mold and furnace comprises moving the mold and furnace relative to another at a rate of less than about 15 inches per hour to cause the molten metal so solidify in the article mold cavity with an equiaxed grain structure.

* * * * *